US005758434A

United States Patent [19]

Gipson

[11] Patent Number: 5,758,434

[45] Date of Patent: Jun. 2, 1998

[54] WOOD DRYING SYSTEM

[75] Inventor: George E. Gipson, Columbia, Miss.

[73] Assignee: Georgia-Pacific Corporation, Atlanta, Ga.

[21] Appl. No.: 747,593

[22] Filed: Nov. 12, 1996

[51] Int. Cl.[6] ..... F26B 3/00

[52] U.S. Cl. ..... 34/340; 34/350; 34/396; 34/470; 34/514

[58] Field of Search ..... 34/330, 340, 343, 34/348, 350, 381, 396, 405, 411, 415, 470, 468, 514, 518, 79, 86, 201, 219, 235, 73, 77, 225, 215, 233; 110/342, 347; 432/13, 18

[56] References Cited

U.S. PATENT DOCUMENTS

| | | | |
|---|---|---|---|
| 763,387 | 6/1904 | Gathmann . | |
| 1,166,819 | 1/1916 | Derby et al. | 34/405 |
| 2,802,281 | 8/1957 | Stone . | |
| 3,728,797 | 4/1973 | Worden, Sr. et al. . | |
| 4,106,215 | 8/1978 | Rosen | 34/217 |
| 4,127,946 | 12/1978 | Bucholz | 34/408 |
| 4,218,832 | 8/1980 | Daniels | 34/79 |
| 4,250,629 | 2/1981 | Lewis . | |
| 4,339,883 | 7/1982 | Waldmann . | |
| 5,080,935 | 1/1992 | Kelso, Jr. et al. | 427/351 |
| 5,228,209 | 7/1993 | Brunner . | |
| 5,237,757 | 8/1993 | Wiedmann et al. . | |
| 5,293,700 | 3/1994 | Ishii . | |
| 5,609,113 | 3/1997 | Galipeault et al. | 110/347 |

*Primary Examiner*—Henry A. Bennett
*Assistant Examiner*—Steve Gravini
*Attorney, Agent, or Firm*—Banner & Witcoff, Ltd.

[57] ABSTRACT

A wood drying system to eliminate the discharge of liquid kiln water includes a kiln which is heated to dry a batch of wood, a basin to collect the water driven from the wood, and an evaporator in which the collected water is converted into steam. The steam is provided to the kiln to balance the drying and alleviate the splitting, warping, etc. caused by over drying. The steam is ultimately vented harmlessly into the atmosphere to effectively eliminate any discharge of the kiln water as a liquid.

12 Claims, 6 Drawing Sheets

WOOD DRYING SYSTEM

FIELD OF THE INVENTION

The present invention pertains to a system for drying wood, particularly stacks of lumber products, in a kiln or the like.

BACKGROUND OF THE INVENTION

In the production of lumber products (e.g., boards, posts, etc.) the wood is dried prior to being planed. Typically, the lumber is stacked on rail cars or other carriages and moved into a kiln for batch drying of the wood. The kiln is heated by a burner to dry the wood over a set period of time. The moisture driven out of the wood is drained from the kiln and discharged into the environment.

The effluent produced during the drying process or during cleaning of the kilns creates a potential environmental hazard when discharged into rivers, lakes or other natural surroundings. States have therefore begun to ban or consider banning the discharge of water from the operation of kilns into the environment. As a result, wood drying facilities are faced with the prospect of shutting down for lack of a solution to the problem of disposing of kiln water.

Wood drying plants have also generally suffered from an inability to provide uniformly dried products ready for planing or other processing. In particular, the moisture content in the individual lumber products is not uniform. Consequently, the time needed to dry each individual piece of wood varies from piece to piece. Nevertheless, for production purposes, the entire stack of wood is heated for a single predetermined time. As a result, some of the wood becomes over dry and suffers from cracking, warping, etc.

The burners of a direct fired kiln or the like are generally fueled, at least in part, by the shavings or other offal produced by planing or other processing of the wood. Using the wood shavings as fuel provides an efficient, cost-effective management of the resources involved in the operation and solves a solid waste disposal problem. However, significant levels of fly ash generated in the burners is blown into the kilns. The ash, in turn, settles on the wood and in the water being driven out of the wood. As can be appreciated, the ash degrades the quality of the lumber, which can require an increase in the planing operation or a reduction in the final value of the product.

SUMMARY OF THE INVENTION

The present invention pertains to a wood drying system which eliminates the discharge of kiln water and enhances the quality of the wood product. In particular, the kiln water is gathered into a collection basin. An evaporator is fluidly coupled to the collection basin to convert the collected water to steam which is introduced into the kiln and harmlessly vented to the atmosphere. In this way, the effluent is safely eliminated without any discharge of the water as a liquid. Further, the use of steam in the kiln balances the drying of the wood so as to avoid splitting, warping, etc. of the lumber products.

In one preferred construction, the kiln is heated by a burner which produces heated air containing ash. An evaporator resides in the blend chamber for distributing the heated air to the kiln so as to mix steam with the heated air. The steam wets the ash and thereby reduces the amount of ash which is actually carried into the kiln. As a result, a higher quality product is provided for the planing operation. In addition, the collection basin separates the ash from the water prior to conducting the water to the evaporator.

DETAILED DESCRIPTION OF THE PREFERRED EMBODIMENTS

A wood drying system 10 (FIGS. 1 and 2) in accordance with the present invention is suited for use in the processing of lumber products 12, such as boards, posts, etc. In particular, drying system 10 operates to completely eliminate the discharge of kiln water into the natural surroundings and thereby avoid the potential environmental hazards heretofore associated with wood drying operations. Moreover, drying system 10 also functions to improve the quality of the lumber products over previous operations.

Figure 1:
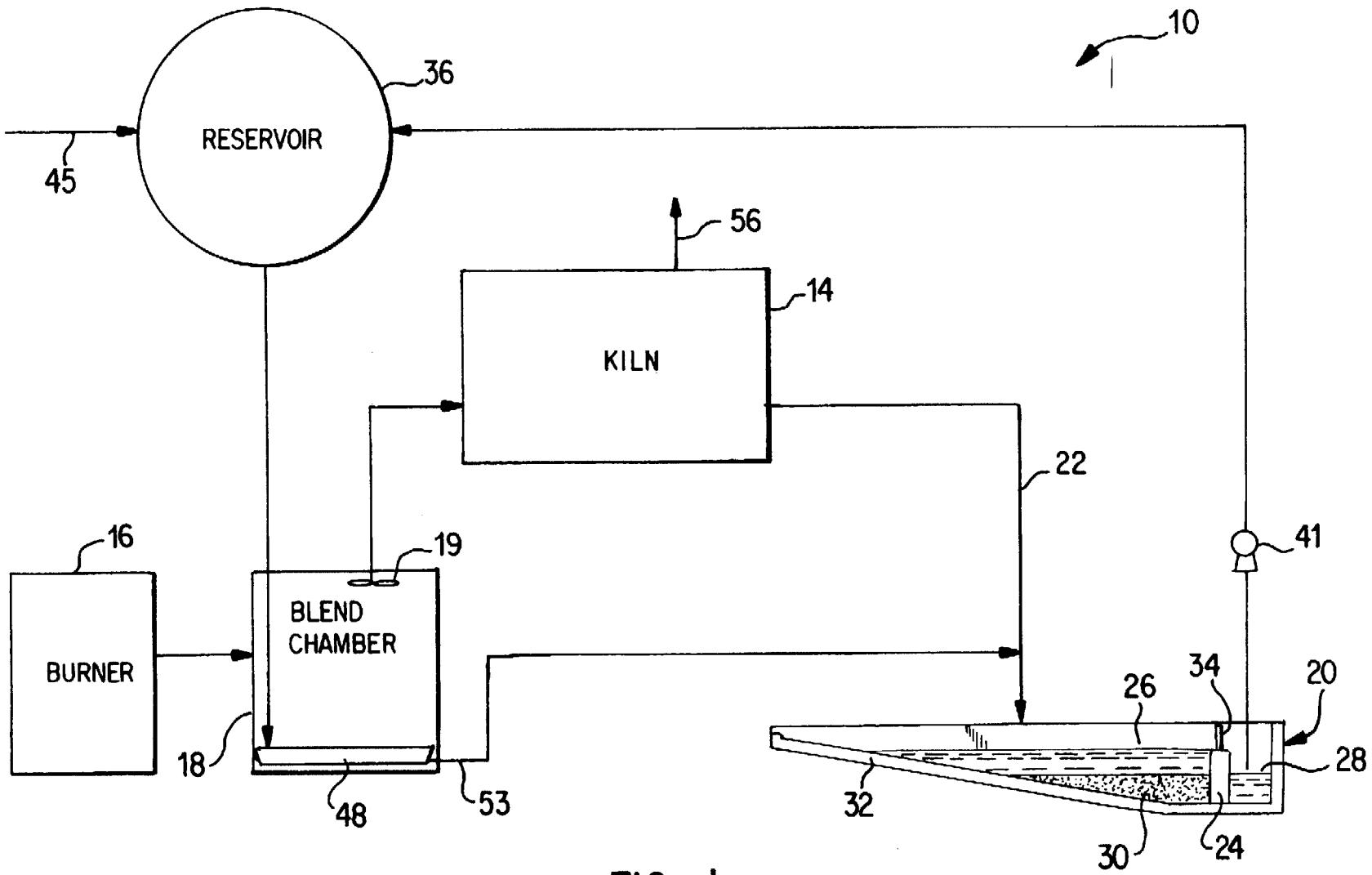
FIG. 1 is a schematic illustration of a drying system in accordance with the present invention.
Figure 2:
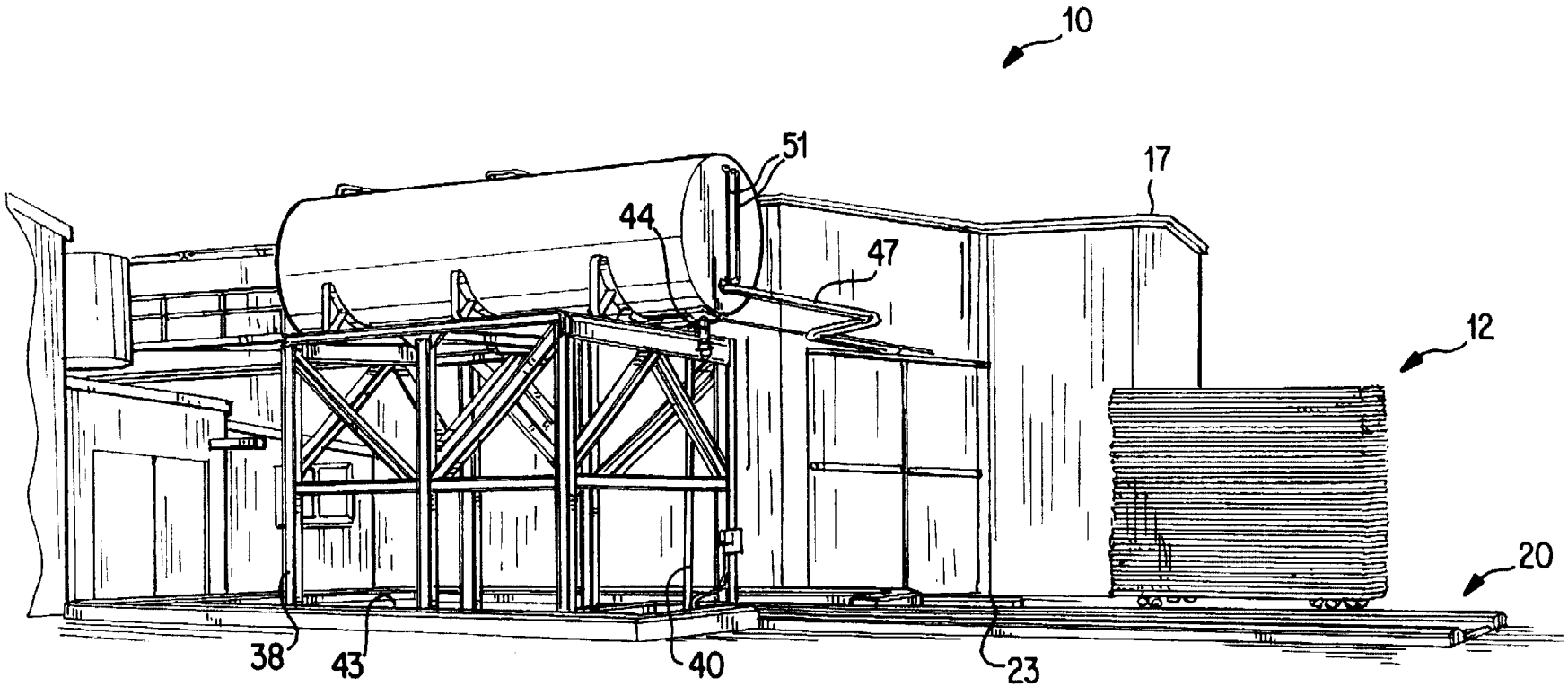
FIG. 2 is a perspective view of a drying system of the present invention.

Drying system 10 includes a kiln 14 for containing and drying the wood over a period of time, a burner 16 or other heater for generating the heat needed to dry the wood, and a blend chamber 18 for distributing the heated air to the kiln (FIG. 1). These three components are typically housed in a common building 17 (FIG. 2).

Figure 3:
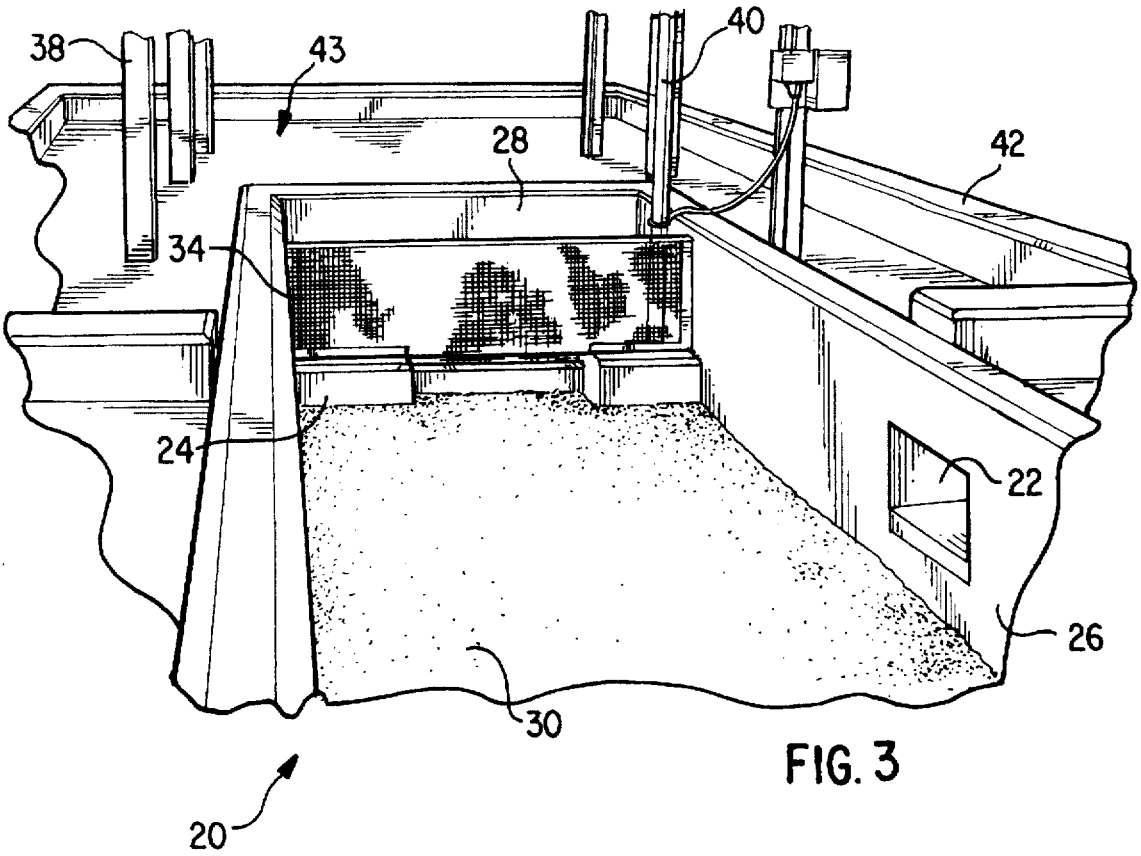
FIG. 3 is a partial perspective view of a collection basin of the drying system.
Figure 4:
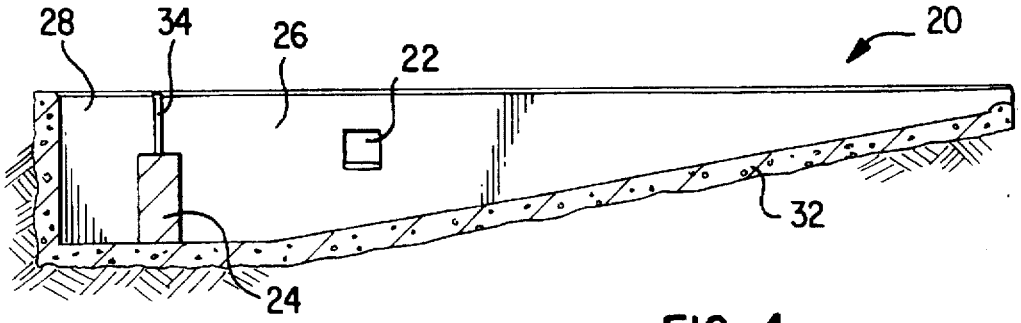
FIG. 4 is a longitudinal sectional view of the collection basin without water.
Figure 5:
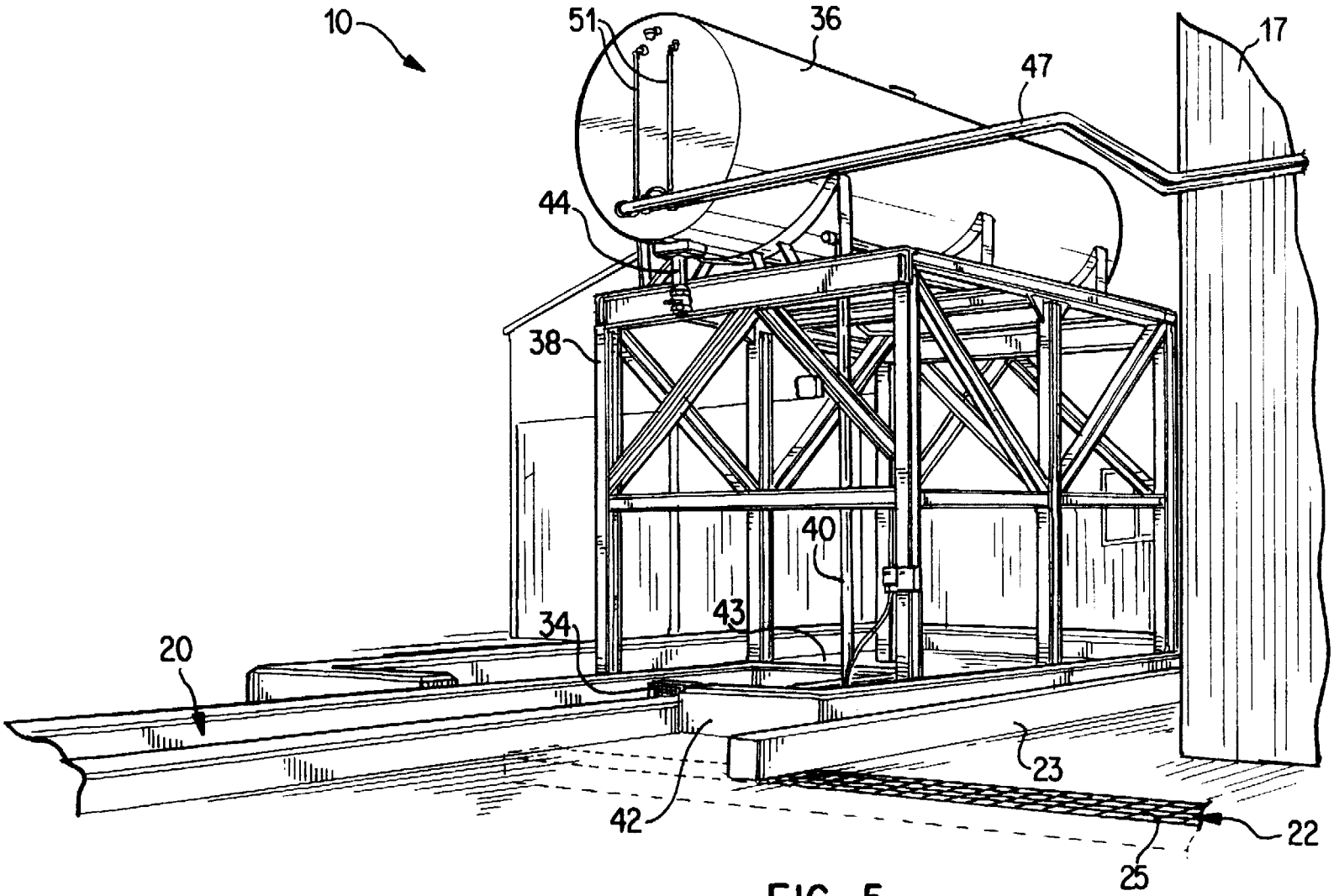
FIG. 5 is a partial perspective view of the drying system.
Figure 6:
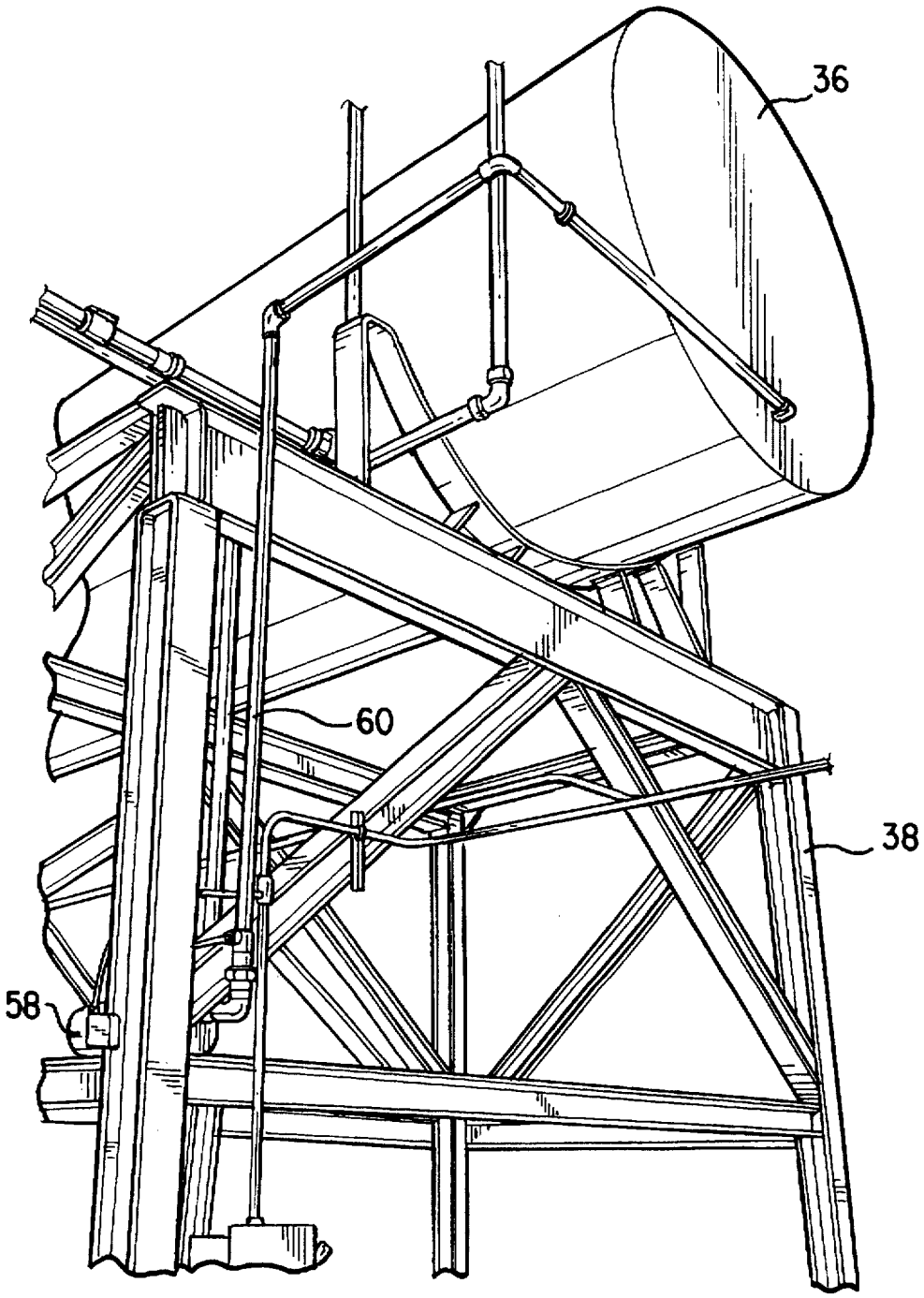
FIG. 6 is a rear partial perspective view of a reservoir of the present invention.

The kiln 14 is typically heated to temperatures generally above 200° F. by burner 16. In a typical operation, a kiln charge of lumber containing 115,000 board-feet is dried for a period of 18 hours in the kiln. This drying process generates on the order of 700 gallons of water per charge. The water driven from the wood flows to the bottom of the kiln where it is drained and fed into a collection basin 20 (FIGS. 1, 3 and 4). In the preferred construction, the kiln water is gravity fed through a drain pipe (not shown) and into a channel 22 which conveys the water to collection basin 20 so that none of the water is lost or discharged to the environment (FIGS. 1, 3 and 5). Also, as a safeguard, a curb border 23 surrounds building 17 (at least on the downgrade sides) in order to contain water which may be lost due to leakage or failure of the equipment (FIGS. 2 and 5). The channel 22 is formed of concrete and covered with a removable lattice 25 to facilitate easy cleaning on a periodic basis.

In one preferred embodiment, the burner is fueled (at least in part) by the wood shavings or other offal of the wood produced during planing or other processing. The blend chamber includes a fan 19 for driving the heated air into the kiln—which is commonly referred to as a direct fired kiln (FIG. 1). As is typical in a direct fired kiln, ash from the burner is conveyed with the heated air into the kiln. Once inside the kiln, the ash tends to settle on the wood and the interior walls of the kiln. Consequently, as the water flows to the drain, it collects the ash which had settled on the wood and inner surfaces of the kiln.

Collection basin 20 is preferably a narrow, elongate concrete trough; although other shapes and constructions could be used (FIGS. 1, 3 and 4). When ash is present, collection basin 20 is partitioned by a wall 24 into a first pool 26 and a second pool 28. The kiln water initially flows from channel 22 into first pool 26. As the water gathers in pool 26, the ash 30 tends to settle to the bottom of the basin. Due to the build up of ash, pool 26 must be periodically cleaned. To facilitate removal of the ash, one end wall 32 of pool 26 has a gradual slope to form a drive upon which a front end loader or the like can be directed into the basin. In this way, the ash can be easily collected for solid waste disposal.

Once the water reaches the top of wall 24, the water will flow through a screen 34 and into second pool 28. The screen is preferably a ⅛ inch mesh screen for filtering ash which may remain in suspension in the water. The water collected in pool 28, which at this point is relatively free of ash, is pumped from basin 20 to a reservoir 36.

In the preferred construction, the reservoir is a 10,000 gallon tank which is supported at an elevated position over collection basin 20 by a metal framework 38 to permit subsequent gravity feed of the water out of the tank (FIGS. 2, 3, 5 and 6). A vertical pipe 40, coupled to a pump 41, conveys the water in pool 28 to reservoir 36 (FIGS. 1–3 and 5). A curb border 42 also surrounds framework 38 to function as a containment pond 43 should leakage of the reservoir tank occur (FIGS. 2–3 and 5). A drain 44 is provided at the bottom of the tank to permit flushing in order to clean ash or other particulate material from the tank (FIGS. 2 and 5). The drain may empty in containment pond 43, or a conduit which directs the water to pool 26 or other container.

An inlet pipe 45, coupled to a fresh water source, is also connected to the tank to supply additional water as needed for the operation or to effect flushing of the tank (FIG. 1). In the preferred construction, the reservoir is fitted with a sensor (not shown) which indicates when the water level reaches a predetermined lower limit. At this point, a sensor transmits a signal to a valve (not shown) to open and provide fresh water into tank 36 through inlet pipe 45. The sensor is preferably at a low level (e.g., within a foot of the tank bottom) to provide the reservoir with the capacity to accept increased volumes of water from the collection basin in case of surges caused by heavy storms. As an additional safeguard, glass sight tubes 51 are provided along the front of tank 36 to provide a visual check of the water level.

The water in reservoir 36 is gravity fed through feed pipes 47 to an evaporator 48 provided in the blend chamber 18 (FIGS. 1, 2 and 5). Evaporator 48 is preferably a stainless steel open basin which is four feet square to substantially cover the bottom of the blend chamber, and 21 inches high to contain sufficient levels of water. Of course, structures of other sizes and shapes could be used to accommodate different blend chambers and different operations. The intense heat (in the range 600°–1200° F.) passed into the blend chamber 18 converts the water in the evaporation basin into steam. In one preferred embodiment, the evaporator converts about 2 to 3 gallons of water per minute to steam.

Figure 7:
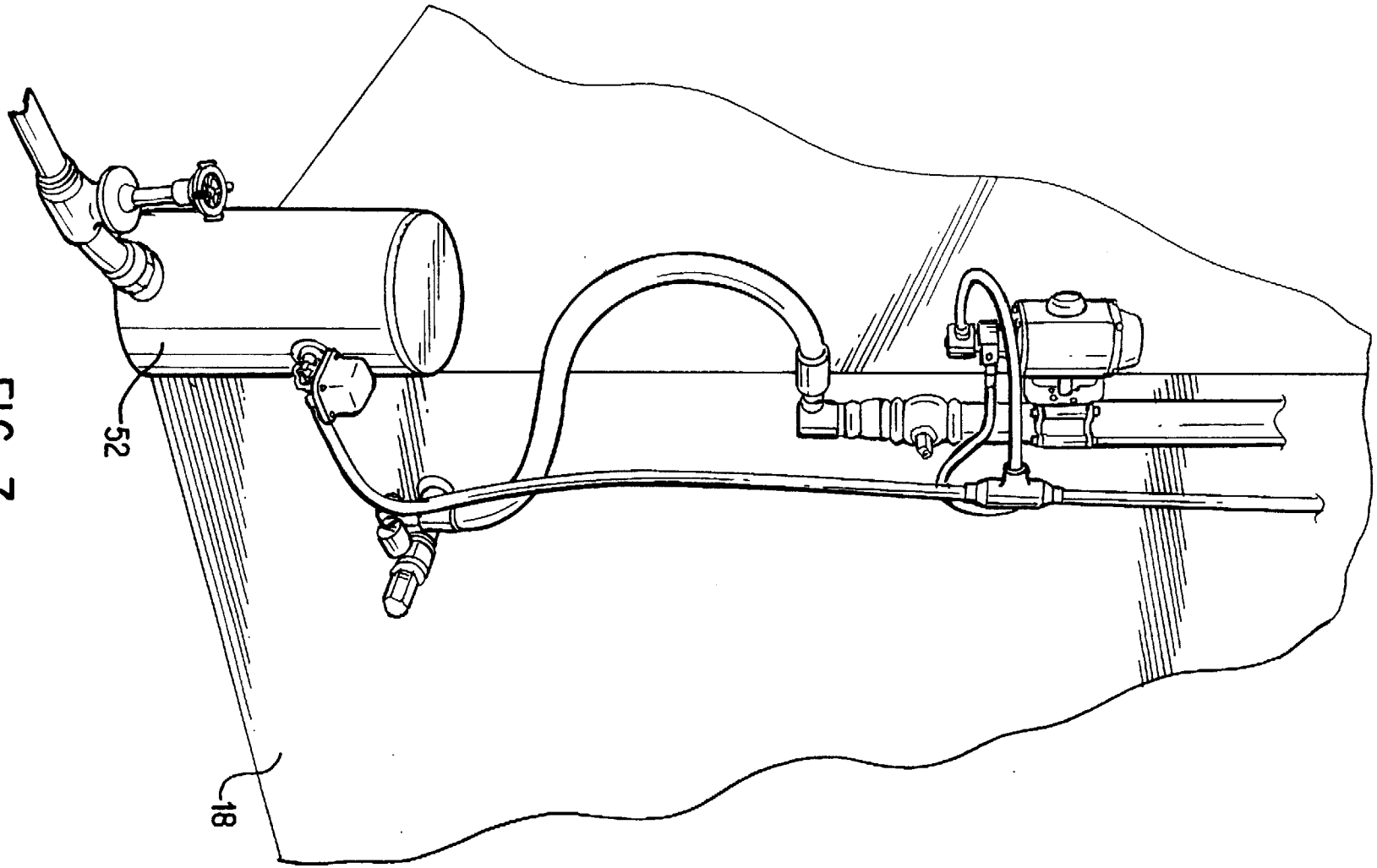
FIG. 7 is a partial perspective view of a vessel housing a gauge for an evaporation basin of the drying system.

A small vessel 52, fluidly coupled to the evaporation basin 48, is provided outside of blend chamber 18 (FIG. 7). Vessel 52 is set at generally the same level as evaporation basin 48 in order to determine the level of water in the basin. A sensor (not shown) is provided with the vessel to open and close a valve (not shown) controlling the flow of water from the reservoir 36.

If ash is present in the air received into the blend chamber, the steam wets the ash causing a portion of it to become heavy and fall into the evaporation basin 48 (FIG. 1). The presence of steam in blend chamber 18 thus results in a reduction of the ash otherwise carried into the kiln. In one preferred embodiment, the steam reduced the amount of ash carried into the kiln by 20–25%. A lessening of the ash in the kiln, in turn, produces a higher quality wood product.

Over time, ash will begin to build up in evaporation basin 48 (FIG. 1). A drain pipe 53 is provided in the bottom of basin 48 to permit cleaning of the basin. In particular, water is delivered from reservoir 36 to basin 48 to permit flushing of the ash from the basin. Drain pipe 53 is relatively large (at least larger than the inlet pipe) to avoid clogging. In one preferred construction, the inlet pipe has a 2 inch internal diameter and the outlet pipe a 2.5 inch internal diameter. If desired, a rake or other manipulator (not shown) may be provided to physically move the ash to the drain.

The steam generated in blend chamber 18 is carried with the heated air into kiln 14 (FIG. 1). The introduction of steam into the kiln functions to balance the drying process so as to avoid over drying of the wood. The steam acts to temper the drying of wood which originally possesses a smaller moisture content than other wood pieces. Consequently, the wood dries more uniformly, without splitting, warping, etc. In addition, the steam has not significantly increased the time needed to dry the wood. The steam is ultimately vented from kiln 14 to the atmosphere via flue 56. In this way, the kiln water can be harmlessly discharged to the atmosphere as steam.

The water in reservoir 36 is also used to periodically clean the interior of the kiln. More specifically, the water is pumped by pump 58 through outlet pipe 60 (FIG. 6) to convey the water to sprayers (not shown) within the kiln. The cleaning water is drained and collected into collection basin 20 in the same way as the kiln water during the drying operation. If necessary, this cleaning water is separated from the ash in basin 20 for return to the reservoir 36.

The above discussion concerns the preferred embodiments of the present invention. Various other embodiments as well as many changes and alterations may be made without departing from the spirit and broader aspects of the invention as defined in the claims.

I claim:

1. A process for drying wood comprising supplying wood to a kiln, heating the kiln to remove water from the wood, removing water from the kiln as a liquid, converting the removed water into steam, supplying the steam to the kiln, and venting the steam from the kiln to the atmosphere so that there is no discharge of liquid water.

2. A process for drying wood in accordance with claim 1 in which heated air is supplied to the kiln for said heating of the kiln, and wherein said heated air is used to convert the water removed from the kiln to steam before the heated air is fed into the kiln.

3. A process in accordance with claim 1 wherein the kiln is heated by a burner which supplies heated air containing ash to the kiln, and wherein the water removed from the kiln includes ash which is then separated from the water.

4. A process for drying wood in accordance with claim 3 in which the water separated from the ash is converted into steam.

5. A process for drying wood in accordance with claim 3 in which the steam is supplied to the heated air outside of the kiln which reduces the amount of ash supplied to the kiln.

6. A process for drying wood comprising supplying wood to a kiln, supplying heated air containing ash to the kiln to dry the wood, and supplying the heated air with steam prior to the heated air entering the kiln and thereby removing a portion of the ash from the heated air.

7. A process in accordance with claim 6 wherein water expelled from the wood is removed from the kiln as a liquid, wherein ash is removed from the kiln with the water, and wherein the ash is separated from the removed water.

8. A process in accordance with claim 7 wherein the steam is generated from the water separated from the ash.

9. A process in accordance with claim 8 in which the steam is fed into the kiln with the heated air and then vented into the atmosphere with no discharge of liquid water.

10. A process for drying wood comprising supplying wood to a kiln, supplying heated air containing ash to the kiln to heat the kiln and remove water from the wood, removing liquid water containing ash from the kiln, separating the ash from the removed water, converting the removed water to steam, supplying the steam to the kiln, and discharging steam from the kiln.

11. A process in accordance with claim 10 in which said water is exposed to said heated air before the heated air is supplied to the kiln to convert the water to steam.

12. A process in accordance with claim 11 in which a portion of the ash in the heated air is removed from the heated air by the steam prior to entering the kiln.

* * * * *